US011447355B2

(12) United States Patent
Sulik et al.

(10) Patent No.: US 11,447,355 B2
(45) Date of Patent: Sep. 20, 2022

(54) ROLLED WEB MATERIAL FEED ASSEMBLY

(71) Applicant: San Jamar, Inc., Elkhorn, WI (US)

(72) Inventors: Jarod Sulik, Elkhorn, WI (US); Bernie Ziebart, Pewaukee, WI (US); Tim Larson, Onalaska, WI (US); Michael Young, Mukwonago, WI (US)

(73) Assignee: San Jamar, Inc., Elkhorn, WI (US)

( * ) Notice: Subject to any disclaimer, the term of this patent is extended or adjusted under 35 U.S.C. 154(b) by 232 days.

(21) Appl. No.: 16/891,691

(22) Filed: Jun. 3, 2020

(65) Prior Publication Data

US 2021/0380363 A1 Dec. 9, 2021

(51) Int. Cl.

| | |
|---|---|
| ***B65H 20/02*** | (2006.01) |
| ***A47K 10/36*** | (2006.01) |
| ***B65H 35/00*** | (2006.01) |
| ***B65H 16/00*** | (2006.01) |
| ***A47K 10/32*** | (2006.01) |

(52) U.S. Cl.

CPC ..... *B65H 20/02* (2013.01); *A47K 10/3656* (2013.01); *B65H 16/005* (2013.01); *B65H 35/008* (2013.01); *A47K 2010/3233* (2013.01); *B65H 2301/51532* (2013.01); *B65H 2701/1924* (2013.01)

(58) Field of Classification Search

None

See application file for complete search history.

(56) References Cited

U.S. PATENT DOCUMENTS

| | | | | |
|---|---|---|---|---|
| 1,716,812 | A | 6/1929 | Ball | |
| 3,552,669 | A | 1/1971 | Earnest | |
| 4,108,513 | A | 8/1978 | Lander | |
| 4,557,426 | A | 12/1985 | Siciliano | |
| 4,712,461 | A * | 12/1987 | Rasmussen | A47K 10/3643 83/337 |
| 5,310,129 | A | 5/1994 | Whittington et al. | |
| 5,441,189 | A * | 8/1995 | Formon | B26F 1/20 225/2 |
| 5,636,812 | A | 6/1997 | Conner et al. | |
| 6,354,533 | B1 * | 3/2002 | Jespersen | A47K 10/36 242/564.4 |
| 6,460,798 | B1 * | 10/2002 | Haen | B65H 35/08 242/564.4 |
| 6,491,251 | B1 | 12/2002 | Stanland et al. | |
| 6,648,267 | B2 | 11/2003 | Stanland et al. | |
| 6,684,751 | B2 | 2/2004 | Kapiloff et al. | |
| 6,736,348 | B1 * | 5/2004 | Formon | A47K 10/3687 242/563 |

(Continued)

FOREIGN PATENT DOCUMENTS

EP 1064876 B1 3/2005

*Primary Examiner* — William A. Rivera

(74) *Attorney, Agent, or Firm* — Boyle Fredrickson S.C.

(57) ABSTRACT

A feed assembly for dispensing rolled web material from a bulk roll of material and that includes a feed drum and a pair of pinch rollers that cooperate with the feed drum. The feed drum and pinch rollers are oriented and constructed to mitigate jamming and/or undesired displacement of the web material as it progresses through the feed assembly. Preferably, a drum guard is disposed between the pinch rollers and is constructed to further mitigate undesired translation of the web material relative to the feed assembly during dispense operations.

12 Claims, 7 Drawing Sheets

(56) References Cited

U.S. PATENT DOCUMENTS

| | | | | |
|---|---|---|---|---|
| 6,736,466 | B1 | 5/2004 | Helland et al. | |
| 7,014,140 | B2 | 3/2006 | Elliott et al. | |
| 7,044,419 | B2 | 5/2006 | Moore | |
| 7,114,676 | B2 | 10/2006 | Elliott et al. | |
| D543,402 | S | 5/2007 | Goeking et al. | |
| D543,745 | S | 6/2007 | Goeking et al. | |
| D556,482 | S | 12/2007 | Goeking et al. | |
| 7,461,810 | B2 | 12/2008 | Goeking et al. | |
| 8,282,033 | B2 * | 10/2012 | Achton | A47K 10/3643 242/560.1 |
| 8,356,767 | B2 | 1/2013 | Formon et al. | |
| 8,479,957 | B2 | 7/2013 | Ophardt | |
| 8,882,021 | B2 | 11/2014 | Cittadino et al. | |
| 8,995,790 | B2 | 3/2015 | Mueller et al. | |
| 9,027,871 | B2 | 5/2015 | Kuehneman et al. | |
| 9,770,143 | B2 | 9/2017 | Corley et al. | |
| 9,839,333 | B2 | 12/2017 | Goeking et al. | |
| 9,999,325 | B2 | 6/2018 | Larson et al. | |
| 10,299,638 | B2 * | 5/2019 | Henson | A47K 10/3687 |
| 10,420,444 | B2 | 9/2019 | Borke | |
| 10,470,622 | B2 | 11/2019 | Boeking et al. | |
| 10,548,437 | B2 | 2/2020 | Borke | |
| 2007/0079676 | A1 | 4/2007 | Friesen et al. | |
| 2019/0106287 | A1 * | 4/2019 | Borke | A47K 10/3625 |
| 2019/0274490 | A1 * | 9/2019 | Trampolski | A47K 10/3687 |
| 2021/0016987 | A1 * | 1/2021 | Trampolski | B65H 16/005 |

* cited by examiner

ROLLED WEB MATERIAL FEED ASSEMBLY

BACKGROUND OF THE INVENTION

The present invention relates generally to rolled web material dispensers and, more specifically, is directed to a feed assembly that is constructed to mitigate instances of premature tearing, jamming, and other instances of deviation of the desired feed arrangement associated with incremental advancement of the rolled web material through the feed mechanism and toward an associated discharge opening.

Dispensers for dispensing discrete portions of paper or web material from bulk rolls of such materials have been employed for many years and across various industries and for various applications. Such dispensers are widely used in public lavatories to dispense paper toweling for users to dry their hands. Typically, a bulk roll of sheet material is supported within a dispenser cabinet or housing and incrementally rotationally advanced to dispense discrete portions of the bulk material roll. In manually operated devices, manual actuation of a button or lever can be used to effectuate initial operation of a feed mechanism configured to rotationally advance the bulk roll and dispense a tail end of the sheet material beyond the confines of the cabinet or housing for use by the user. Once the tail of the rolled web material has been presented, subsequent use of the rolled web material dispenser assembly can be effectuated by user interaction with the available portion of the webbed material to effectuate subsequent dispensing of discrete portions or volumes of the web material from the bulk roll source.

The feed mechanism typically includes a feed roller that is associated with one or more adjacent rollers, such as a drive roller, an idle roller, and/or one or more pinch rollers to effectuate the desired sequential incremental advancement of the web material from the bulk roll. As mentioned above, a manually actuated button, lever, or dial can be provided and oriented to interact with one or more of the respective rollers to effectuate at least an initial material discharge event.

Alternative dispensers, which eliminate or limit manual operation or physical interaction with the structures of the roll material dispensing systems, are often referred to as "contactless" or "touchless" dispensers. When provided in an electronically operable modality, such dispensers commonly employ one or more proximity sensors that detect the presence of a hand of other part of a user relative to the dispenser and include a motorized feed assembly that advances the feed mechanism to effectuate dispensing of the sheet material from the housing. When provided in a touchless and manually operable configuration, user interaction with an exposed tail of the web material is commonly employed to effectuate the sequential discharge operation and/or to cause rotation of the drive roller or feed drum to effectuate the act of unwinding the web material from the material roll, passage of the web material through the feed assembly, sometimes perforation thereof, and ultimately dispensing of a portion of the web material through the discharge opening defined by the dispenser assembly.

Dispensers for rolls of flexible sheet material, whether manually operated, operated in the touchless manner, or a combination thereof, when deployed in restroom, industrial or commercial environments, are often subject to high volumes of repetitive usage. Additionally, many dispensers are configured to receive and dispense various types of web material. For example, in the context of hand towel dispensers, such dispensers may receive rolls of single-ply or multi-ply material. Additionally, the rolls of material may be of variable thickness, absorbency, density, core structure, etc. Accordingly, such dispensers are often not customized to dispense a specific material, but rather are provided with sufficient tolerances as to accommodate various materials. Such wide tolerances may result in some web materials performing at a higher desired level than others. That is to say, for example, a given dispenser may perforate or sever and dispense a multi-ply material with more consistency than a single-ply material. Or alternatively, a given dispenser may generate undesirable hanging material tabs through incomplete cuts and/or may be prone to material folding and jamming in the feeder assembly when dispensing a given type of webbed material. That is to say, some applications associated with the use of such rolled web material dispensers require suitable tolerances to accommodate multiple material types which may adversely impact performance of the dispenser.

When provided in a manual touchless dispense operation modality, user interaction with the tail end of the web material to initiate or otherwise effectuate the dispense operation can further frustrate the desired continuous operation of the dispenser assembly. Poor, undesired, or unacceptable performance of the dispenser assembly may include but is not limited to slipping or jamming of the web material in the feed mechanism, incomplete tearing of the material, and/or undesirable overlapping of the web of material, and/or the imparting of undesired tensile forces to the remainder of the roll of web material during dispensing during undesired or incomplete tearing or perforating operations. Such considerations can be exacerbated by the inability of the dispenser assembly to accommodate variations in the manner in which user's tear a discrete portion of web material from the dispenser. That is, aggressive interaction with the tail end of the web material in any direction, or more lateral loading of the tail end associated with single handed interaction therewith, can result in undesired lateral translation of the web material relative to the feed assembly and tends to lead to more aggressive jamming of the web material in the feed mechanism. If sever enough, such jamming can render the dispenser assembly unusable until serviced.

Such performance issues may require premature replacement of the roll of web material and/or service of the dispenser including unloading and reloading unconsumed rolls of web material in response to undesired jamming of the web material during use thereof. Replacement of spoiled rolls of web material, roll realignment, and jam correction are both a time consuming and wasteful side effect associated with an underperforming rolled web material dispensers.

In an effort to mitigate the detriments of such events, some dispenser assemblies are configured to receive and dispense only one specific type of web material. By narrowly defining the parameters of the web material accepted in the dispenser, the assembly's tolerances can be narrowly tailored, and performance optimized for dispensing that specific material. However, customers often do not wish to be limited to a single web material option, and desire to have flexibility in selecting the type of material that will be dispensed from the assembly. In such dispensers, it is not feasible to narrow the tolerances as to accommodate only a single web material type. Such considerations and the dispense operation and separation of discrete portions of the roll of web material can be exacerbated in instances where the roll of web material is provided in a non-uniform construction, such as if the web material is provided with reinforcement members that extend the longitudinal length of the rolled material. Although such reinforcements improve the tensile performance of the web material, particularly when gripped by wet hands, the reinforcements can frustrate efforts intended to mitigate jamming of web material during the dispensing operations.

Accordingly, there is a need for a web material dispenser feed assembly and a method of forming such a dispenser feed assembly that can better tolerate deviations in the characteristics of the web material and differences associated with the user's interaction with the tail end of the web material that allows the web material to be cleanly and repeatedly torn from the roll of material in a manner that mitigates undesired translation of the web material relative to the feed assembly such that the dispenser assembly remains operable for subsequent users.

SUMMARY OF THE INVENTION

The present invention discloses a web material dispenser feed assembly that resolves one or more of the shortcomings disclosed above and that is constructed to mitigate jamming of the feed assembly in response to user interaction with the web material. Therefore, one aspect of the present application discloses a feed assembly for rolled web material dispensers that includes a feed drum and a pair of pinch rollers that cooperate with the feed drum. The feed drum and pinch rollers are oriented and constructed to mitigate jamming and/or undesired displacement of the web material as it progresses through the feed assembly and ultimately is discharged from the dispenser to a user. Preferably, a drum guard is disposed between the pinch rollers and is constructed to further mitigate undesired translation of the web material relative to the feed assembly during dispense operations.

Another aspect of the present application that is usable or combinable with one or more of the above aspects includes a feed assembly for use in a rolled web material dispenser. The feed assembly includes a first support and a second support that are each constructed to be supported by an enclosure of a rolled web material dispenser. A feed drum extends between the first support and the second support such that the feed drum is rotational relative thereto. A first pinch roller is oriented forward of the feed drum and biased into engagement with an exterior surface thereof and a second pinch roller is oriented generally below the feed drum such that an axis of rotation of the second pinch roller is radially offset from an axis of rotation defined by the first pinch roller and such that an exterior surface of the second pinch roller is engaged with the exterior surface of the feed drum.

A further aspect of the present application that is usable or combinable with one or more of the above aspects includes a rolled web material feed assembly. The feed assembly includes a feed roller having at least one radial groove formed in an exterior surface thereof. The feed assembly includes a first pinch roller and a second pinch roller that both engage the feed roller and are configured to pass web material therebetween during rotation of the feed roller. A guard is disposed between the first pinch roller and the second pinch roller along a radial portion of the feed roller. A guide arm extends from the guard and passes into the at least one radial groove formed in the feed roller to further mitigate undesired translation of the web material relative to the feed roller and the respective pinch rollers.

Another aspect of the present application that is combinable and/or useable with one or more of the aspects or features above includes a method of forming a rolled web material feed assembly. The method includes providing a feed drum that is rotationally supported between a first mount arm and a second mount arm. The first mount arm and the second mount arm are constructed to cooperate with a rolled web material dispenser housing. A first pinch roller and a second pinch roller are provided and are disposed proximate the feed drum. A compressible layer is provided on at least one of the first pinch roller and the second pinch roller. A drum guard is provided that defines at least one radially extending material guide that extends across a radial footprint of the feed drum and is disposed between the first pinch roller and the second pinch roller. The material guide is constructed an oriented to mitigate undesired lateral and axial translation of the web material during dispense operations and in response to user interaction therewith.

These and other aspects, features, and advantages of the present invention will become apparent from the detailed description, claims, and accompanying drawings.

DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE PREFERRED EMBODIMENTS

Figure 1:
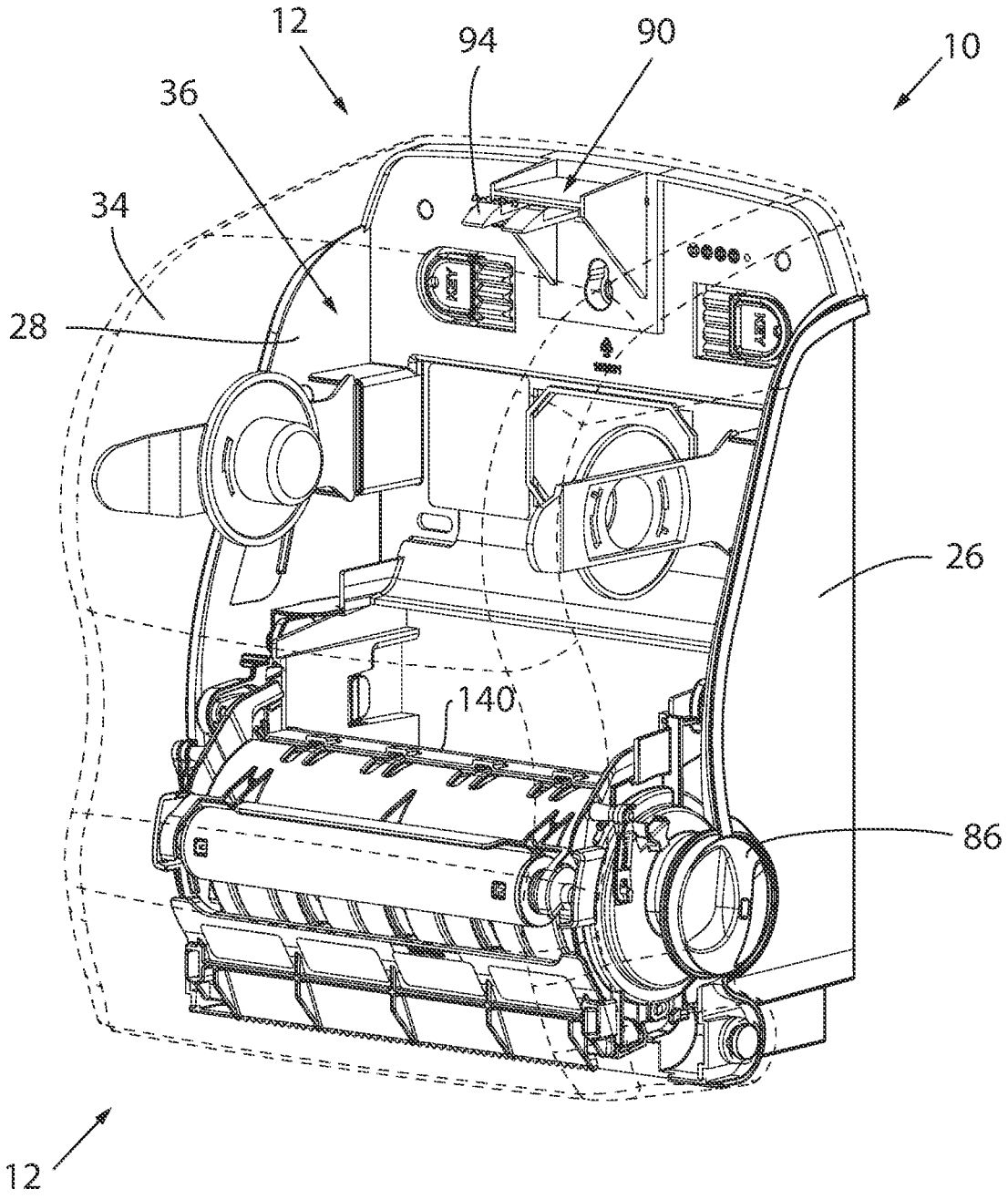
FIG. 1 is a perspective view of a roll material dispenser assembly equipped with a feed assembly according to the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. The various features and advantageous details of the subject matter disclosed herein are explained more fully with reference to the non-limiting embodiments described in detail in the following description.

Figure 2:
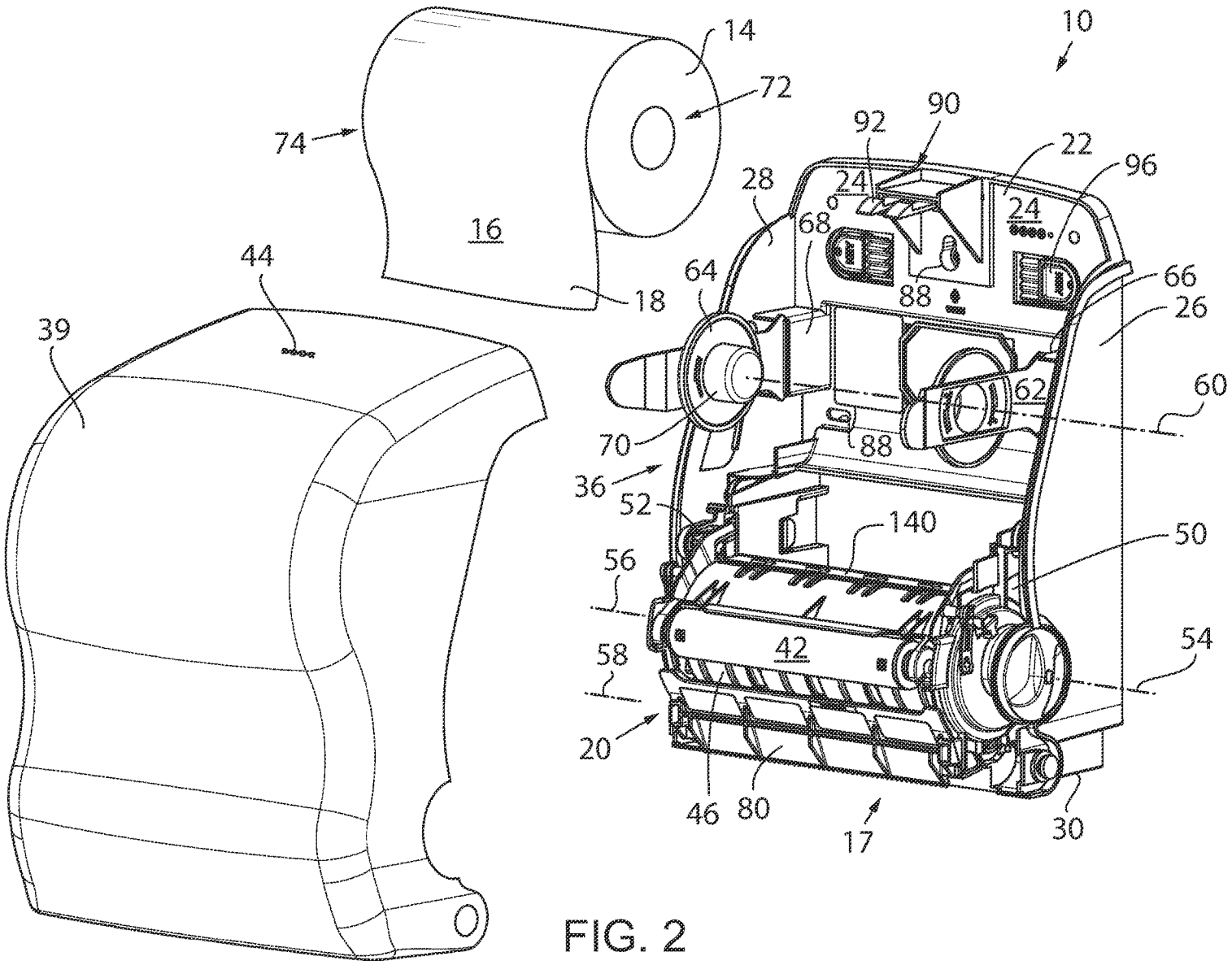
FIG. 2 is a perspective view of the roll dispenser assembly of FIG. 1 with the cover and a bulk roll of web material exploded therefrom and exposing an interior of the base of the housing or enclosure of the dispenser assembly.

Illustrative embodiments of a dispenser assembly 10 in accordance with various aspects of the present invention are shown in FIGS. 1 and 2 and various views of a feed mechanism or feed assembly 20 and features thereof are show in FIGS. 3 through 9. Referring to FIGS. 1 and 2, material dispenser or dispenser assembly 10 includes a housing or enclosure 12 that is constructed to accommodate a bulk roll 14 of a web material 16 therein. During dispensing of the bulk roll 14 of web material 16 via dispenser assembly 10, the web material 16 sequentially cooperates with the feed mechanism or feed assembly 20 that gradually unwinds the web material 16 from bulk roll 14 as the bulk roll 14 is consumed from a tail end 18 toward an internally oriented end of each discrete bulk roll 14. Gradual unwinding of the web material 16 from tail end 18 accommodates sequential unwinding of each discrete bulk roll 14 of web material 16 as it passes in a generally uninterrupted, incremental, and serpentine manner through feed assembly 20 and toward a discharge opening 17 defined by enclosure 12 for use by user's thereof.

Figure 3:
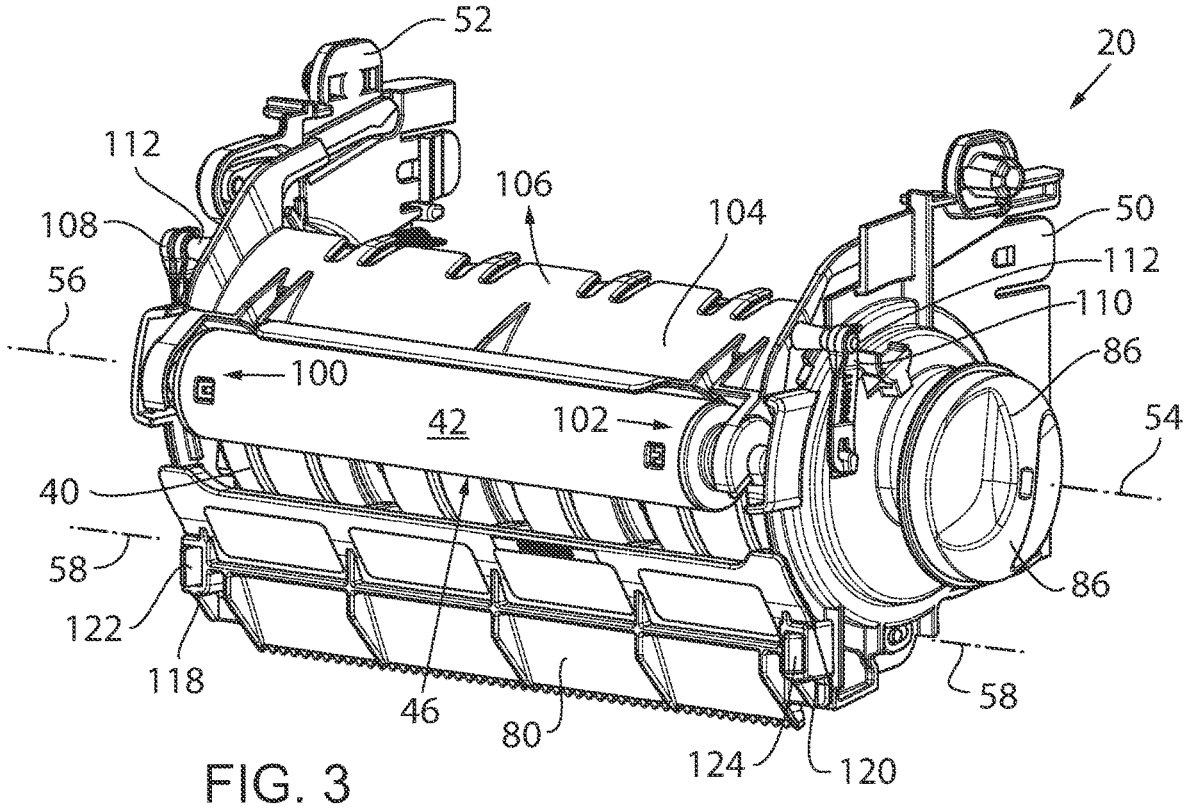
FIG. 3 is perspective view of the feed assembly shown in FIG. 2 removed from the dispenser assembly and from a front, elevated, right side thereof.
Figure 4:
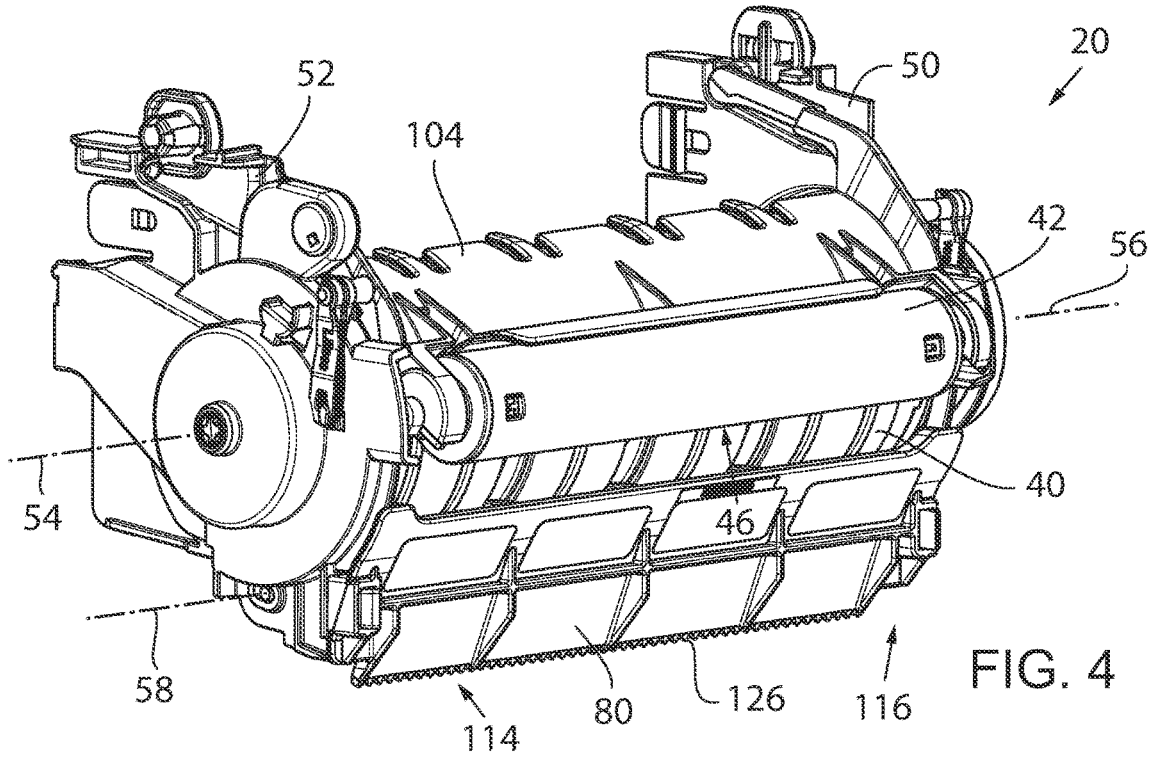
FIG. 4 is a view of the feed assembly shown in FIG. 3 from a front, elevated, left side thereof.

Referring to FIGS. 1-3, enclosure 12 of dispenser assembly 10 is generally shaped to receive replaceable bulk rolls 14 of sheet or web material 16 such that the roll is rotatable relative thereto. Enclosure 12 is generally defined by a base 22 that preferably defines one or more of a back wall 24, a first sidewall 26, a second opposing sidewall 28, and a floor 30. It is appreciated that back wall 24, sidewalls 26, 28 and floor 30 of base 22 may be provided in either a connectable modality or more preferably provided in a unitary single body construction.

Enclosure 12 includes a cover 34 that pivotably cooperates with base 22 such that base 22 and cover 34 cooperate with one another to define a selectively exposable or accessible interior cavity 36 of enclosure 12. Enclosure 12 may be formed of plastic or other suitable materials. Further, although shown as transparent or translucent in FIG. 1, thereby allowing visual inspection of the cavity 36 defined by enclosure 12, it should be appreciated that cover 34 may be opaque. Regardless of its relative opacity, cover 34 movably cooperates with base 22 of enclosure 12 to allow selective exposure or access to cavity 36 associated with receiving discrete bulk rolls 14 of web material 16 associated therewith. As disclosed above, it is appreciated that each of base 22 and cover 34 may be formed as single body structures or multiple piece assemblies formed by injection, blow, roto molding, or other suitable manufacturing modalities. Alternatively, the various walls or panels that define enclosure 12 may be separately manufactured parts that are connected by methodologies such as welds, moldings, fasteners, solder, overlapping snap fit connections, pivots, or the like.

Still referring to FIGS. 1-3, feed assembly 20 is generally contained within enclosure 12 and disposed proximate discharge opening 17. Although shown as an assembly that cooperates with enclosure 12, it is appreciated that in other embodiments, the feed assembly 20 can be provided in the form of a cassette as shown in FIGS. 3-6 that can be assembled prior to being associated with enclosure 12. As disclosed further below, feed assembly 20 is preferably constructed to be fully assembly prior to being associated with enclosure 12 and subsequently snap-fittingly cooperating therewith. Regardless of the specific configuration, feed assembly 20 includes one or more rollers such as a drive roller or feed roller or feed drum 40, and one or more idle or pinch rollers 42, 44 that are positioned relative to one another and relative to feed drum 40 to effectuate the sequential dispensing of web material 16 beyond the confines of enclosure 12 to a user.

Feed drum 40 and upper or first pinch roller 42 and lower or second pinch roller 44 form discrete pinch points or pressure nips 46, 48 through which web material 16 is drawn prior to being dispensed beyond the confines or perimeter edge of enclosure 12. Feed drum 40 and pinch rollers 42, 44 extend transversely with respect to and are supported by respective mounts or support arms 50, 52 that are constructed to secure feed assembly 20 relative to enclosure 12 such that drum 40 and rollers 42, 44 are rendered rotatable about respective parallel axes 54, 56, 58 (FIG. 2). It will be appreciated that these axes are also generally parallel to the rotational axis 60 (FIG. 2) of the bulk roll 14 of sheet or web material 16 associated with dispenser assembly 10.

Still referring to FIGS. 2 and 3, the roll of sheet or web material 16 is configured to be retained within cavity 36 of enclosure 12, generally above feed assembly 20. For example, a first roll retaining arm 62 may extend outwardly from the rear wall or first sidewall of base 22 and an opposing second roll retaining arm 64 may extend from the rear wall or opposing side wall of base 22. The first and second retaining arms 62, 64 may be received and retained within respective first and second receiving slots 66, 68 adjacent the intersection of the rear wall 24 and respective first and second side walls 26, 28, respectively. A hub 70 extends inwardly from an outwardly extending end of the first and second arms 62, 64 and when used in combination are configured to rotatably receive the opposing longitudinal ends or sides 72, 74 of the bulk roll 14 of sheet or web material 16.

In this configuration it will be appreciated that the roll of sheet or web material 16 is rotatably suspended above the feed assembly 20, to spin about axis 60 that extends transversely with respect to the sidewalls 26, 28 of enclosure 12 and generally parallel to the rotational axis 54 of feed drum 40, axis 56 of first pinch roller 42, and axis 58 of second pinch roller 44. From this rotatably mounted position, tail end 18 of bulk roll 14 of web material 16 associated with bosses 70 extends downwardly for cooperation with the pressure nip 46 associated with first pinch roller 42, progresses in a rearward rotational direction, is associated with second pressure nip 48 associated with second pinch roller 44, passes behind a drum guard 80, and progresses toward a downwardly directed discharge opening 17 defined by enclosure 12. In one embodiment of the present invention, where the dispenser operated in an electronic and contactless methodology, rotational advancement of feed drum 40 is effectuated by user interaction with a touchless operator, such as a proximity sensor or the like, to effectuation operation of feed assembly 20.

As disclosed further below with respect to FIGS. 3-9, when configured for manual operation, user interaction with tail end 18 of bulk roll 14 of web material 16, having been passed through feed assembly 20, effectuates rotational advancement of feed drum 40, extraction of a cut or perforated portion of the web material 16, and presentation of a subsequent tail portion of the web material 16 below the discharge opening 17 for grasping by a successive user. If a tail of the web material fails to present for successive users or is otherwise not available for grasping, and for initial association of tail end 18 with feed assembly 20, feed assembly 20 of dispenser assembly 10 includes a manual actuator 86, such as a wheel, lever, or dial, that may be manually actuator by a user or service personnel to advance web material 16 from bulk roll 14 in a serpentine manner through the discharge path defined by feed drum 40 and pinch rollers 42, 44 and therefrom toward the dispense or discharge opening 17 defined by enclosure 12.

Still referring to FIGS. 1 and 2, a plurality of mounting holes or apertures 88 are located in rear or back wall 24 of enclosure 12. The apertures 88 are configured to receive mounting hardware, such as a threaded fastener or peg, therein such that material dispenser assembly 10 may be affixed to a vertical support such as a wall of the like. When the dispenser is mounted and a bulk roll 14 of web material 16 has been loaded into the cavity 36, with an end of the web material 16 extending downwardly within the pressure nip 48 associated with second pinch roller 44 (FIG. 5), enclosure 12 is closed when cover 34 is rotated toward the rear or base 22 of enclosure 12 as shown in FIG. 1. Preferably, dispenser assembly 10 includes a lock mechanism 90 that is configured to provide only selective access to cavity 36 of enclosure 12 for service and/or reloading operations.

Lock mechanism preferably includes a resilient barb 92 that extends outwardly from the rear wall 24 of the base 22 of the enclosure 12 near the top of the dispenser assembly 10. When closed, the resilient barb 92 deflects about and engages a corresponding fixed barb (not shown) disposed at the interior surface of cover 34. Such a configuration allows the overlapping barbs to maintain a friction fit closure between the cover 34 and base 22 of enclosure 12 when dispenser assembly 10 is closed. A keyhole 94 is positioned in a portion of cover 34 at a location that overlies the resilient barb 92 when the dispenser assembly 10 is in the closed configuration. Inserting a corresponding elongated key 96 (once removed from base 22) through the keyhole 94 allows the key 96 to downwardly deflect the resilient barb 92 and release the cover 34 from its engagement with the rear portion of the enclosure 12 to allow opening of dispenser assembly 10.

Turning now to FIGS. 3-9, and initially FIGS. 3-6, feed assembly 20 of the dispenser assembly 10 is shown removed from enclosure 12. Opposing longitudinal ends 100, 102 of first pinch roller 42 are rotationally supported by a carrier 104 that is pivotably connected to respective support arms 50, 52. Carrier 104 allows pinch roller 42 to rotate in a generally upward direction, indicated by arrow 106 (FIG. 3) in a direction away from feed drum 40 during the initial passage of tail end 18 of bulk roll 14 of web material 16 therebetween.

A first retainer 108 and a second retainer 110 are associated with first and second support arms 50, 52 and engage respective posts 112 associated with the opposing longitudinal ends of carrier 104 when web material 16 is disposed between pinch roller 42 and feed drum 40. When engaged with carrier 104 and respective arms 50, 52, retainers 108, 110 prevent rotational translation of carrier 104 in direction 106 and thereby maintain the desired orientation of pinch roller 42 in a position wherein pinch roller 42 is disposed in a position associated with compressive engagement with feed drum 40 when web material 16 is captured therebetween. As disclosed further below, a radially outward facing surface of one or more of pinch roller 42, feed drum 40, pinch roller 44 preferably include a rubberized layer or material disposed over at least a portion of the radially exterior facing surface thereof and which is oriented to engage web material traversing thereover.

Drum guard 80 is disposed generally below pinch roller 42 and the pressure nip 46 defined between pinch roller 42 and feed drum 40. Opposing longitudinal ends 114, 116 of drum guard 80 include respective cavities 118, 120 formed thereat. Cavities 118, 120 are constructed to slideably cooperate with respective posts 122, 124 defined by respective support arms 50, 52 such that drum guard 80 can be snap-fittingly secured relative to feed drum 40. Second pinch roller is disposed generally behind drum guard 80 when drum guard 80 is attached to support arms 50, 52.

A downward facing edge 126 of drum guard 80 includes a plurality of teeth 128 that define a supplemental cutting or tearing edge that extends in a generally downward direction therefrom. Teeth 128 are preferably constructed to effectuate final separation between adjacent portions of web material 16 in those instances when cutting blade supported by feed drum 40 fails to effectuate full separation therebetween as is disclosed further below.

Figure 5:
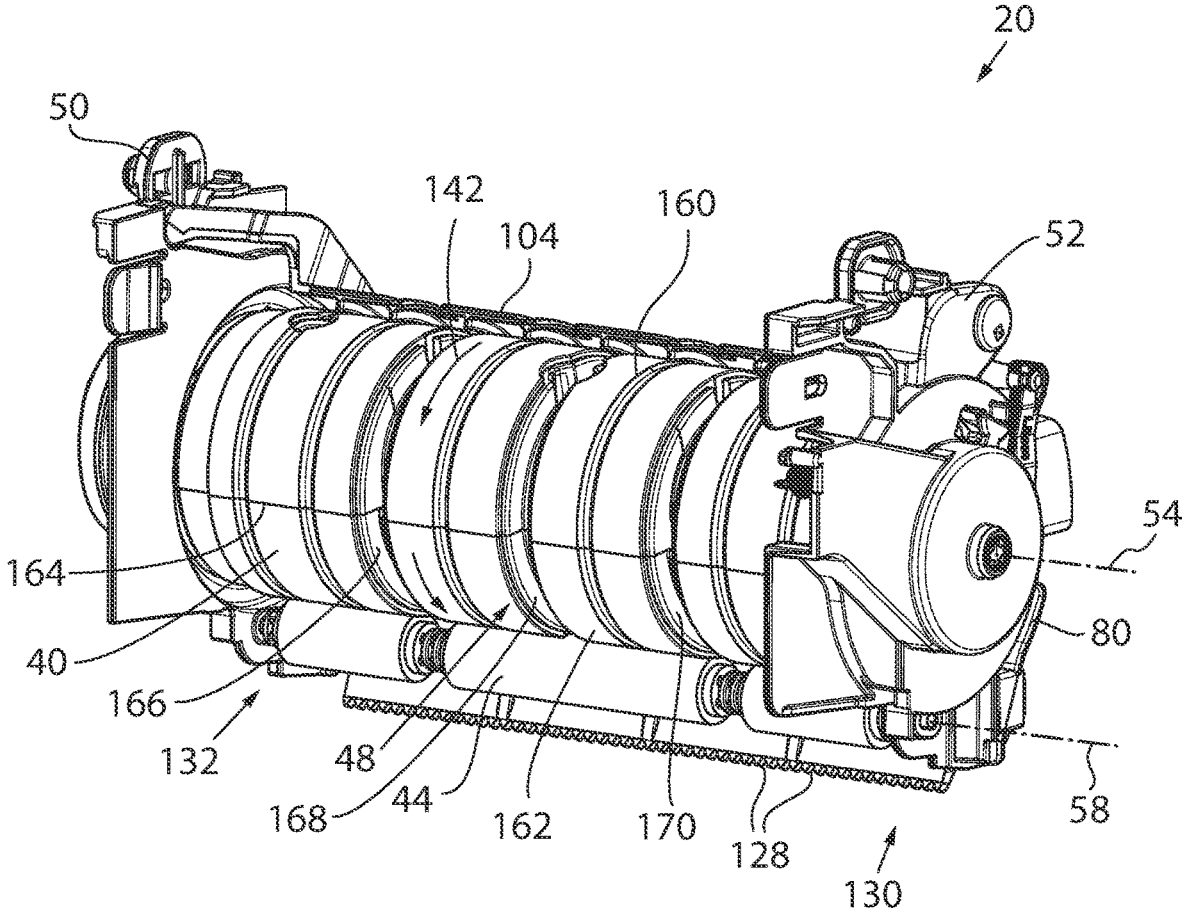
FIG. 5 is a view similar to FIGS. 3 and 4 and shows the feed assembly from a rear, elevated, left side thereof.
Figure 6:
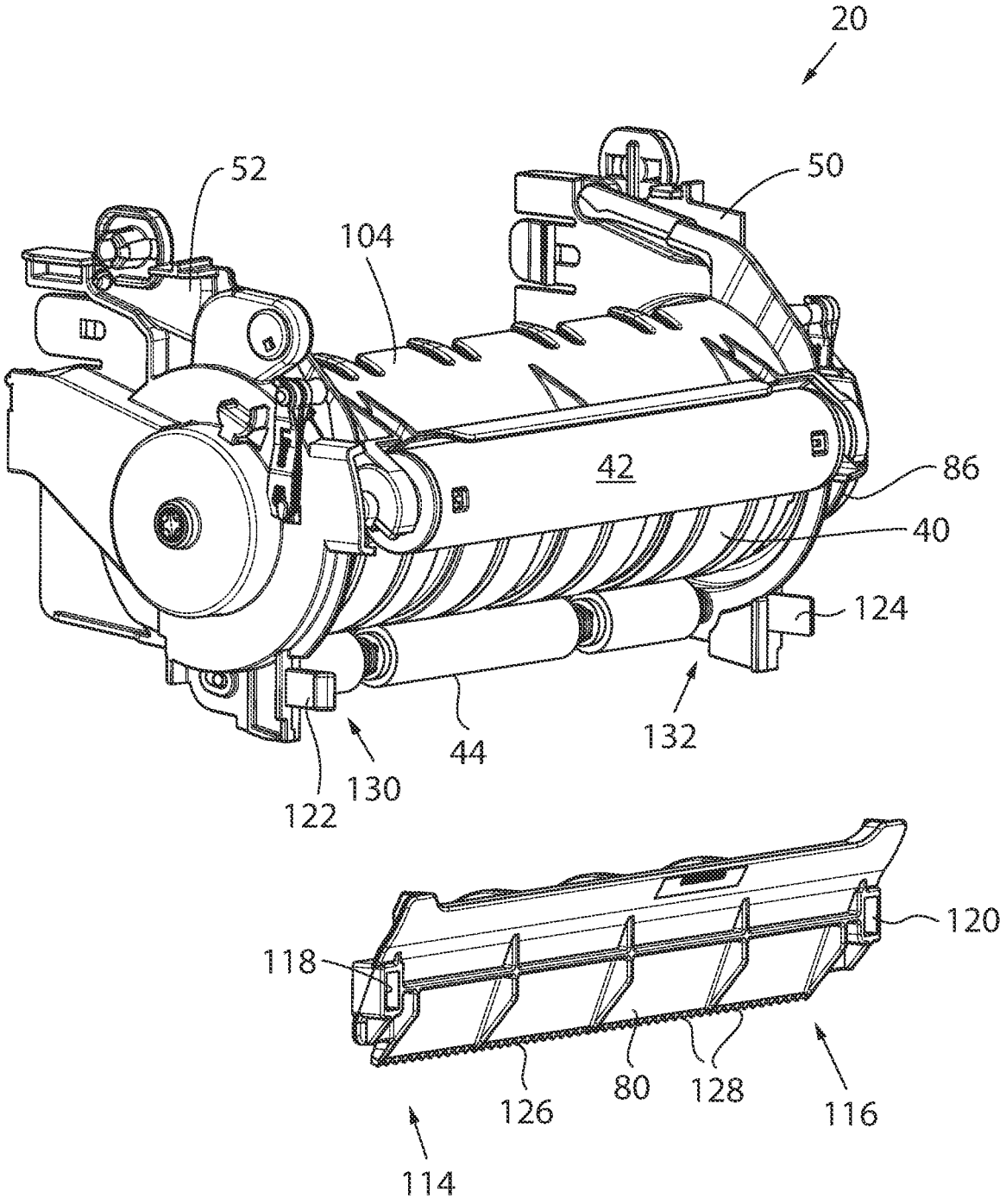
FIG. 6 is a view similar to FIG. 4 and shows a drum guard exploded from the feed assembly shown therein.

As shown in FIGS. 5 and 6, opposing longitudinal ends 130, 132 of pinch roller 44 cooperate with respective support arms 50, 52 such that second pinch roller 44 is rotatable relative thereto. Preferably, pinch roller 44 cooperates with respective oblong openings defined by support arms 50, 52 to allow a limited range of translation of pinch roller 44 relative to support arms 50, 52 and thereby dampen excessive forces imparted to an exposed tail end 18 of web material 16 by a user extraction action. The slideable association of pinch roller 44 provided by the respective oblong openings allows pinch roller 44 to gravitationally dissociate from feed drum 40 during non-operation of feed assembly 20. During dispensing operation, pinch roller 44 is biased in a direction toward feed drum 40 due to translation of the web material therebetween.

Figure 7:
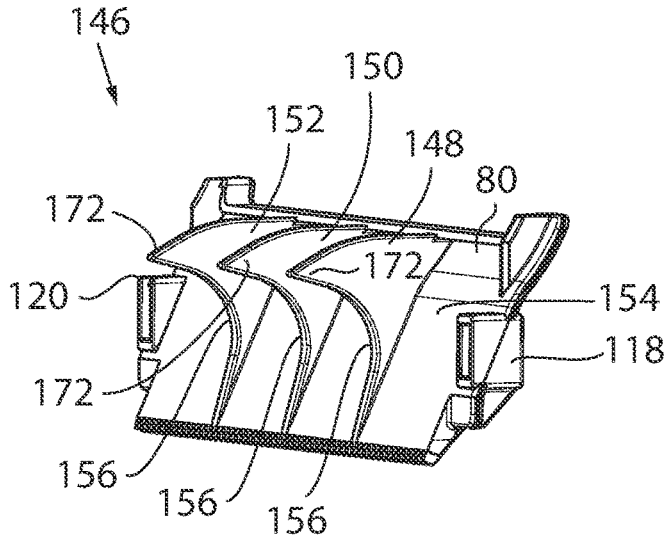
FIG. 7 is a perspective view of the drum guard shown in FIG. 6 and shows a drum facing side thereof.
Figure 8:
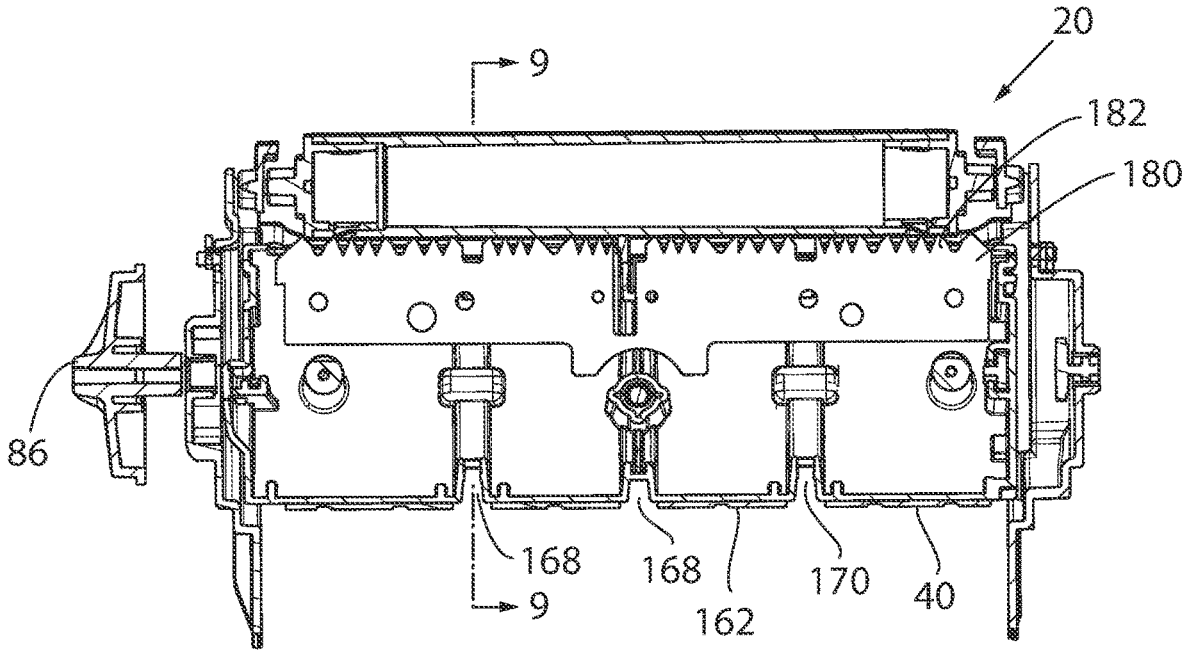
FIG. 8 is a cross-sectional view of the feed assembly shown in FIGS. 3-6 and taken along line 8-8 shown in FIG. 9 and shows a cutting blade supported by the feed assembly.
Figure 9:
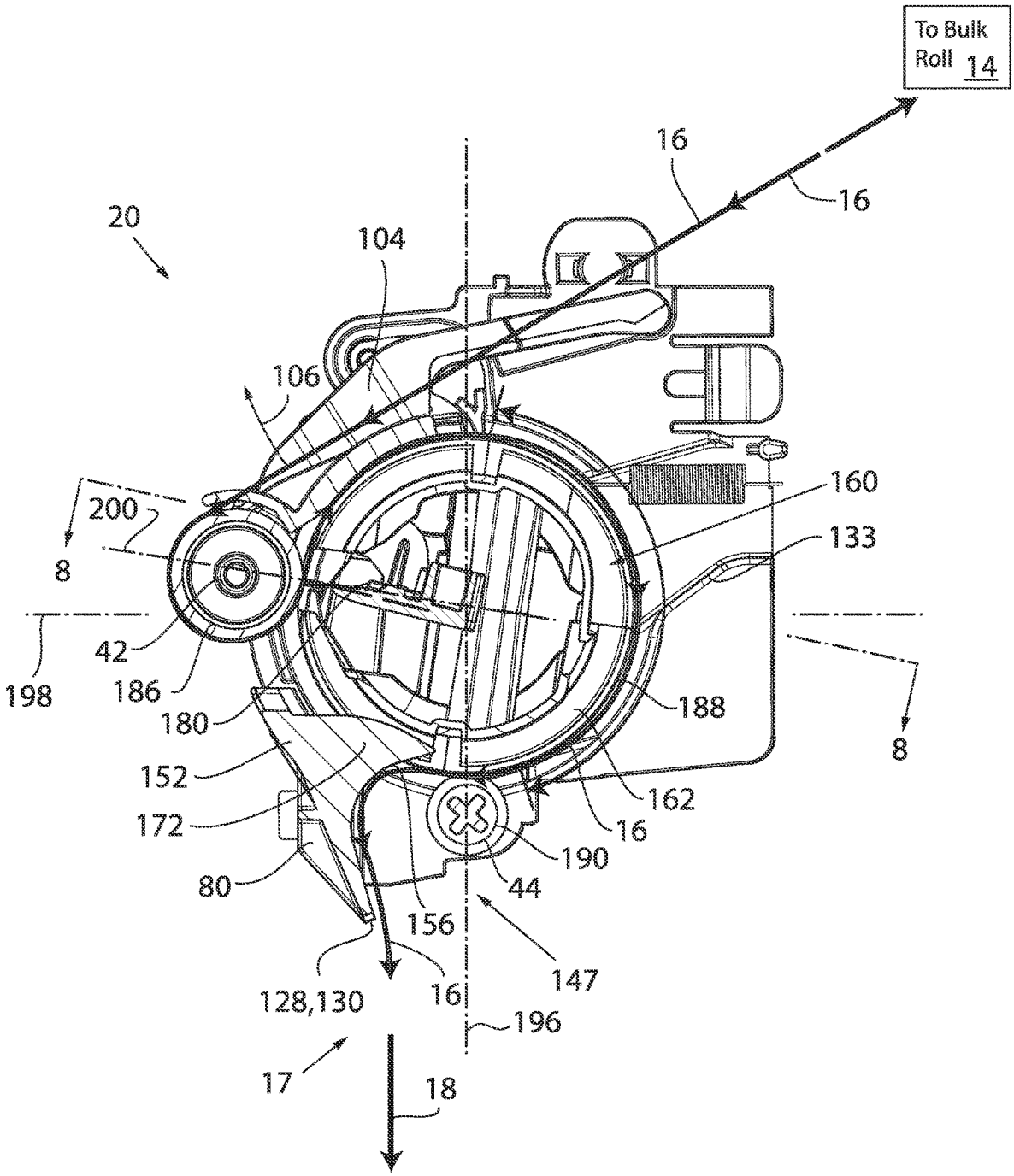
FIG. 9 is a cross section elevation view of the feed assembly taken along line 9-9 shown in FIG. 8.

Referring briefly to FIGS. 7 and 8, second pinch roller 44 cooperates with feed drum 40 such that rotation of feed drum 40 effectuates rotation of pinch roller 44 in response to the progression of the tail end 18 of web material 16 therebetween. Referring briefly to FIGS. 2, 5, and 9, it should be appreciated that a radially outer surface of feed drum 40, indicated by arrow 133 in FIG. 9, that is generally rearward of carrier 104 located above feed drum 40 and the rearward facing area proximate pressure nip 48 defined by second pinch roller 44 are generally oriented in close proximity to a curvilinear shroud 140 (FIG. 2) defined by base 22 such that web material 16 progressing around feed drum 40 in the direction indicated by arrow 142 (FIG. 5; and represented by the arrowed line in FIG. 9) is guided generally under carrier 104, between feed drum 40 and shroud 140, and into the passage defined by pressure nip 48 associated with pinch roller 44 and feed drum 40, and into an area 147 generally between drum guard 80 and lower pinch roller 44 prior to passing toward dispense area or opening 17 (FIG. 2) defined by enclosure 12.

Referring to FIG. 7, a drum facing side 146 of drum guard 80 includes a plurality of projections or fingers 148, 150, 152 that extended generally rearward toward relative to a body 154 of drum guard 80. As disclosed further below, when assembled, fingers 148, 150, 152 are constructed to cooperate with respective grooves formed in an exterior surface of feed drum 40. A material guide or a shoe 156 is formed along at least a portion of each respective finger 148, 150, 152 and is oriented to further mitigate undesired lateral and/or axial translation of web material 16 relative to pinch roller 44 and drum 40 as disclosed further below.

Referring to FIGS. 5, 7, and 8, feed drum 40 is preferably formed of opposing halves or portions 160, 162 that cooperate with one another along a longitudinal seam line 164 to define a generally cylindrical shape of feed drum 40. A plurality of circumferential grooves 166, 168, 170 formed in an exterior radial surface of feed drum 40 are oriented and constructed to allow a distal portion 172 (FIGS. 7 and 9)

associated with each finger 148, 150, 152 defined by drum guard 80 to pass into or within a radial footprint defined by feed drum 40 as shown in FIG. 9. As disclosed further below, the cooperation of fingers 148, 150, 152 with grooves 166, 168, 170 operate to guide web material 16 passing through area 147 (FIG. 9) toward the discharge opening 17 defined by dispenser assembly 10. Referring to FIG. 8, a perforation or cutting blade 180 is supported by feed drum 40 and is generally internal thereto. During a portion of the rotational operation of feed drum 40, a cutting edge 182 defined by cutting blade 180 periodically protrudes beyond the radial footprint of feed drum 40 so as to engage web material 16 traversing thereover. The moveable operation and the construction of cutting blade 180 is further disclosed in applicant's copending application titled "Roll Material Dispenser Tear Bar" filed on an even date herewith.

Referring to FIG. 9, one or more of feed drum 40, pinch roller 42, and pinch roller 44 include a rubber layer 186, 188, 190 that is formed over at least a portion of the radially outward directed surface thereof and being oriented to engage the opposing rollers when no web material is associated therewith. When assembled and configured for dispensing operation, one or more of rubber layers 186, 188, 190 are compressed into engagement with one another and thereby resist undesired lateral, axial, or transverse translation of the web material 16 passed therebetween. The interaction between pinch roller 44, and the rubber layer 190 associated therewith, and the underlying feed drum further resists communication of non-axial forces imparted to tail end 18 of web material 16 during the removal operation by the user and thereby provides improved maintaining of a substantially planar interaction between web material 16 and the area 133 rotationally rearward of pressure nip 48 associated with the engagement between feed drum 40 and pinch roller 44. As disclosed above, as the web material traverses between feed drum 40 and pinch roller 44, pinch roller 44 translates in a direction toward feed drum 40 to effectuate compression of rubber layer 190 thereby providing a secure axial interaction with the web material and further mitigates undesired translation of the web material relative to feed assembly 20 and those portions of the web material that are oriented rotationally rearward of pressure nip 48.

Still further, the relative orientation of pinch roller 42 and pinch roller 44 relative to feed drum 40 and the relative location associated with discharge areas or openings 147 and 17 have shown to provide marked improvement in the repeatable or continued operation of dispenser assembly 10 even during variable user forces being imparted to tail end 18 of web material 16. The toothed edge 126 of drum guard 80 and the generally forward and downward relative location associated with area 147 acts to improve separation performance without detrimentally affecting the sequential dispense operation of dispenser assembly 10. As shown in FIG. 9, the axis of rotation of feed drum 40 and pinch roller 44 are generally vertically aligned with one another as indicated by an imaginary vertical plane indicated by line 196. Comparatively, pinch roller 42 is disposed at a generally forward oriented position relative to feed drum 40 and is oriented relative thereto such that the axis of rotations of pinch roller 42 and feed drum 40 are associated with a gravitationally horizontal plane, indicated by line 198, or are oriented in a generally horizontal plane, as indicated by line 200.

Although pinch roller 42 is shown as being oriented near the horizontal plane 198 and pinch roller 44 is shown as being oriented nearer to vertical plane 196 than pinch roller 42 is to horizontal plane 198, it is appreciated the pinch rollers 42 and 44 could be oriented at locations other than those shown in FIG. 9 as being preferred. Preferably, pinch roller 42 is oriented in a radially forward facing quadrant of feed drum 40 that is bifurcated by horizontal plane 198 and pinch roller 44 is oriented in a radially downward facing quadrant of feed drum that is bifurcated by vertical plane 196. The relative spatial orientation of pinch rollers 42, 44 relative to feed drum 40, the orientation of drum guard 80 at a location circumferentially between pinch rollers 42, 44, the radially overlapping interference of fingers 152 with the respective channels or grooves of feed drum 40, and the improved frictional interface associated with one or more feed drum 40 and pinch rollers, each contribute to the ability of feed assembly 20 to mitigate instances of jamming or undesired translation of web material 16 relative to the feed assembly 20 and do so in a manner that maintains the operational integrity of feed assembly 20.

It is appreciated that the invention has been shown and described in what is perceived to be the most practical and preferred embodiments. It is to be understood that the invention is not intended to be limited to the specific features and preferred embodiments set forth above. Rather, it is recognized that modifications may be made by those of skill in the art of the invention without departing from the spirit or intent of the invention and, therefore, the invention is to be taken as including all reasonable equivalents to the subject matter of the appending claims.

Therefore, one aspect of the present application discloses a feed assembly for rolled web material dispensers that includes a feed drum and a pair of pinch rollers that cooperate with the feed drum when the web material is disposed therebetween. The feed drum and pinch rollers are oriented and constructed to mitigate jamming and/or undesired displacement of the web material as it progresses through the feed assembly and ultimately is discharged from the dispenser to a user. Preferably, a drum guard is disposed between the pinch rollers relative to a circumferential direction and is constructed to further mitigate undesired translation of the web material relative to the feed assembly during dispense operations.

Another aspect of the present application that is usable or combinable with one or more of the above aspects includes a feed assembly for use in a rolled web material dispenser. The feed assembly includes a first support and a second support that are each constructed to be supported by an enclosure of a rolled web material dispenser. A feed drum extends between the first support and the second support such that the feed drum is rotational relative thereto. A first pinch roller is oriented forward of the feed drum and biased in a direction toward engagement with an exterior surface thereof and a second pinch roller is oriented generally below the feed drum such that an axis of rotation of the second pinch roller is radially offset from an axis of rotation defined by the first pinch roller and such that an exterior surface of the second pinch roller selectively translates in a direction toward the exterior surface of the feed drum in response to the web material passing therebetween.

A further aspect of the present application that is usable or combinable with one or more of the above aspects includes a rolled web material feed assembly. The feed assembly includes a feed roller having at least one radial groove formed in an exterior surface thereof. The feed assembly includes a first pinch roller and a second pinch roller that both cooperate with the feed roller and are configured to pass web material therebetween during rotation of the feed roller. A guard is disposed between the first pinch roller and the second pinch roller along a radial portion of the feed roller.

A guide arm extends from the guard and passes into the at least one radial groove formed in the feed roller to further mitigate undesired translation of the web material relative to the feed roller and the respective pinch rollers.

Another aspect of the present application that is combinable and/or useable with one or more of the aspects or features above includes a method of forming a rolled web material feed assembly. The method includes providing a feed drum that is rotationally supported between a first mount arm and a second mount arm. The first mount arm and the second mount arm are constructed to cooperate with a rolled web material dispenser housing. A first pinch roller and a second pinch roller are provided and disposed proximate the feed drum. A compressible layer is provided on at least one of the first pinch roller and the second pinch roller. A drum guard is provided that defines at least one radially extending material guide that extends across a radial footprint of the feed drum and is disposed between the first pinch roller and the second pinch roller. The material guide is constructed an oriented to mitigate lateral and axial translation of the web material during dispense operations and in response to user interaction therewith.

Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims. The present invention has been described in terms of the preferred embodiment, and it is recognized that equivalents, alternatives and modifications, aside from those expressly stated, are possible and within the scope of the appending claims.

What is claimed is:

1. A feed assembly for use in a rolled web material dispenser, the feed assembly comprising:

a first support and a second support that are each constructed to be supported by an enclosure of a rolled web material dispenser;

a feed drum extending between the first support and the second support such that the feed drum is rotational relative thereto;

a first pinch roller oriented forward of the feed drum and biased toward an exterior surface thereof;

a second pinch roller oriented generally below the feed drum such that an axis of rotation of the second pinch roller is radially offset from an axis of rotation defined by the first pinch roller and such that an exterior surface of the second pinch roller is translated toward the exterior surface of the feed drum in response to web material passing therebetween;

a drum guard oriented to extend along a radial portion of a circumference of the feed drum and disposed between the first pinch roller and the second pinch roller; and a toothed surface formed along a portion of the drum guard oriented toward the second pinch roller.

2. The feed assembly of claim 1 further comprising a rubber layer formed about an exterior surface of at least one of the first pinch roller and the second pinch roller.

3. The feed assembly of claim 2 wherein the rubber layer is compressed toward the exterior surface of the feed drum.

4. The feed assembly of claim 1 further comprising a holder that supports the first pinch roller and is pivotably engaged with the first support and the second support.

5. The feed assembly of claim 1 further comprising a plurality of fingers extending from a drum facing surface of the drum guard and oriented such that each finger traverses an imaginary plane defined by a cross-sectional footprint of the feed drum.

6. The feed assembly of claim 5 wherein at least one of the fingers includes a guide shoe that extends in a direction generally aligned with an axis of rotation of the feed drum.

7. The feed assembly of claim 1 disposed in a housing defined by a cover that is pivotably connected to a base and having a pair of opposing roll support hubs disclosed generally above the feed assembly.

8. A method of forming a rolled web material feed assembly, the method comprising:

providing a feed drum that is rotationally supported between a first mount arm and a second mount arm;

constructing the first mount arm and the second mount arm to cooperate with a rolled web material dispenser housing;

providing a first pinch roller and a second pinch roller that are disposed about the feed drum;

providing a compressible layer on at least one of the first pinch roller and the second pinch roller;

providing a drum guard that defines at least one radially extending material guide that extends across a radial footprint of the feed drum and is disposed between the first pinch roller and the second pinch roller; and forming a toothed surface on an edge of the drum guard that is nearer the second pinch roller.

9. The method of claim 8 further comprising providing a compressible layer on an exterior surface of the other of the first pinch roller and the second pinch roller.

10. The method of claim 8 further comprising orienting an axis of rotation defined by the first pinch roller substantially forward of an axis of rotation of the feed drum and orienting an axis of rotation defined by the second pinch roller substantially below the axis of rotation of the feed drum.

11. The method of claim 8 further comprising forming a plurality of material guides that extend from the drum guard.

12. The method of claim 11 further comprising forming a shoe on an edge of at least one of the plurality of material guides and such that the shoe extends in a crossing direction relative to the at least one of the plurality of material guides.

* * * * *